US005257950A

United States Patent [19]

Lenker et al.

[11] Patent Number: 5,257,950

[45] Date of Patent: * Nov. 2, 1993

[54] FILTERED ELECTRICAL CONNECTOR

[75] Inventors: William G. Lenker, Marysville; George R. Lurie, Harrisburg; Jeffrey L. Showers, Mechanisburg, all of Pa.

[73] Assignee: The Whitaker Corporation, Wilmington, Del.

[ * ] Notice: The portion of the term of this patent subsequent to Sep. 22, 2009 has been disclaimed.

[21] Appl. No.: 888,471

[22] Filed: May 21, 1992

Related U.S. Application Data

[63] Continuation of Ser. No. 731,579, Jul. 17, 1991, abandoned.

[51] Int. Cl.[5] ..... H01R 13/66

[52] U.S. Cl. ..... 439/620; 333/185

[58] Field of Search ..... 439/620; 333/181-185

[56] References Cited

U.S. PATENT DOCUMENTS

| | | | |
|---|---|---|---|
| 4,682,129 | 7/1987 | Bakermans et al. | 333/184 |
| 4,726,638 | 2/1988 | Farrar et al. | 439/620 |
| 4,761,147 | 8/1988 | Gauthier | 439/607 |
| 4,772,224 | 9/1988 | Talend | 439/620 |
| 4,784,618 | 11/1988 | Sakamoto et al. | 439/620 |
| 4,791,391 | 12/1988 | Linnell et al. | 333/184 |
| 4,853,659 | 8/1989 | Kling | 333/184 |
| 4,931,754 | 6/1990 | Moussie | 333/184 |
| 4,992,060 | 2/1991 | Meyer | 439/620 |
| 4,995,834 | 2/1991 | Hasegawa | 439/620 |
| 4,999,595 | 3/1991 | Azumi et al. | 333/185 |
| 5,082,457 | 1/1992 | Wollscheidt et al. | 439/620 |
| 5,150,086 | 9/1992 | Ito | 333/181 |

FOREIGN PATENT DOCUMENTS

| | | | |
|---|---|---|---|
| 19686 | 1/1989 | Japan | 439/620 |

*Primary Examiner*—Gary F. Paumen

*Attorney, Agent, or Firm*—Katherine A. Nelson; Anton P. Ness

[57] ABSTRACT

A filtered connector 20 includes a housing means 22 having a plurality of terminal members 42 disposed therein with terminal portions 46 extending outwardly thereof, filter means 48 and grounding means 38. Filter means 48 includes a planar inductive substrate 50, a plurality of terminal receiving passageways 58 extending therethrough and configured to receive corresponding ones of the terminal member portions 46. An array of capacitors 60 is disposed on substrate 50, such that each capacitor 60 is associated with a corresponding terminal receiving passageway 58. In the preferred embodiment, each capacitor 60 includes a first or signal electrode 62, a layer of dielectric material 66 having a selected thickness disposed on the first signal electrode over at least most of the exposed surface thereof; and a second or a ground electrode 68 disposed on layer 66, the ground electrode 68 being electrically isolated from the signal electrode and in capacitive relationship therewith. Ground electrode 68 is adapted for electrical connection with the connector ground means. The signal electrode 62 is exposed for electrical connection to a respective terminal member 42 after insertion of the terminal member 42 through the passageway 58.

13 Claims, 6 Drawing Sheets

FILTERED ELECTRICAL CONNECTOR

This application is a continuation of application Ser. No. 07/731,579 filed Jul. 17, 1991, now abandoned.

FIELD OF THE INVENTION

This invention relates to electrical connectors and more particularly to filtered electrical connectors and filtering devices for providing protection against electromagnetic interference and radio frequency interference.

BACKGROUND OF THE INVENTION

Electrical circuitry often must be protected from disruptions caused by electromagnetic interference (EMI) and radio frequency interference (RFI) entering the system.

Frequently today's electronic circuitry requires the use of high density, multiple contact electrical connectors. There are many applications in which it is desirable to provide a connector with a filtering capability, for example, to suppress EMI and RFI. To retain the convenience and flexibility of the connector, however, it is desirable that the filtering capability be incorporated into connectors in a manner that will permit full interchangability between the filtered connectors and their unfiltered counterparts. In particular, any filtered connector should also in many instances retain substantially the same dimensions as the unfiltered version and should have the same contact arrangement so that either can be connected to an appropriate mating connector.

One means to protect against undesirable interference without altering the internal structure of a connector is by the use of shielding. The shielding may take several forms. For adequate protection, it is essential, however, that there be no break in continuity of the shielding. In some instances, it is desirable to provide a combination of shielding and filtering. For ease of manufacturing assembly it is also desirable to provide filtering capability with a minimum number of parts. One way to achieve this result is to use thick film capacitors such as those described in U.S. Pat. Nos. 4,682,129 and 4,791,391. These capacitors are formed on electrically inert substrates. The insertion loss obtainable with these devices depends, therefore, solely on the value of the capacitors. For some applications, these capacitor devices can not achieve the desired insertion loss. It is desirable, therefore, to have a planar filter construction that meets industry demands for filtered connectors having higher insertion loss.

SUMMARY OF THE INVENTION

Accordingly, the present invention is directed to a filter means for use in an electrical connector that alleviates problems associated with the prior art. The connector includes housing means having a plurality of terminal members disposed therein and grounding means. The filter means including a planar substrate having an array of capacitors disposed on at least one side thereof, each capacitor being associated with and adapted for electrical engagement with one of the plurality of terminal members upon insertion of the filter means into the connector; and means for grounding the capacitors. The planar substrate of the filter means is preferably made from an inductive material such as ferrite. The planar substrate has first and second major surfaces. A plurality of terminal receiving passageways extend through the planar member and are aligned with corresponding terminal receiving passageways in the housing means. The capacitors are disposed on at least one major surface such that each capacitor is associated with a corresponding terminal receiving passageway. In the preferred embodiment the capacitors are defined by a layer of conductive material disposed in a plurality of discrete conductive areas, each area including a conductive pad portion surrounding the end of an associated terminal passageway and electrically engagable with an electrical terminal member upon insertion into the associated passageway defining a signal electrode; a thickness of dielectric material disposed over portions of the conductive areas and a second conductive layer disposed over the dielectric material such that the edges of the second conductive layer are electrically isolated from the first conductive areas, the second layer being electrically engagable with grounding means and defining a ground electrode for the array of capacitors. The terminal members are disposed within respective housing and filter passageways, each terminal member having a first portion matable with corresponding terminal members in a complementary mating connector, and a second portion extending through the board mounting face of the housing means and through the filter means. The second connecting portion of each terminal member is electrically engagable with the first conductive layer or signal electrode of the associated capacitor on the second major surface of the filter means and is adapted to engage corresponding conductive means of another electrical article.

In an alternate embodiment, the capacitors are defined by a common first electrically conductive layer defining a ground electrode for the capacitors, the layer having annular edges proximate but spaced a selected distance from and surrounding each passageway entrance, thereby defining exposed annular substrate portions immediately adjacent each respective passageway entrance, the first conductive layer being electrically engagable with grounding means. A thickness of dielectric material is disposed at least on the exposed substrate portions about the passageway entrances and extends over the annular edges of the first conductive layer surrounding the apertures. Annular second electrically conductive layers associated with and surrounding respective ends of the passageways are disposed on and overlie the dielectric material about the passageways, thereby forming conductive pad portions surrounding the ends of each passageway. The pad portion is electrically engagable with an electrical terminal member upon insertion into the associated passageway. The pad portion further extends outwardly to an outer edge to partially overlie the annular edges of the first conductive layer, but is electrically isolated therefrom. The second portion of the terminal members are electrically engaged with the pad portion and the first conductive layer is electrically engaged with ground means of the connector.

It is an object of the present invention to provide electrical filtering means that can be added to an existing unfiltered connector.

It is another object of the invention to provide a filtered connector having a minimum of parts.

It is also an object of the invention to provide a filtering means for connectors that is cost effective to manufacture and assemble.

It is a further object of the invention to provide a filter assembly having enhanced performance by providing increased insertion loss above and beyond that obtained by thick film capacitors formed on electrically inert substrates.

This invention itself, together with further objects and its attendant advantages, will be best understood by reference to the following detailed description, taken in conjunction with the accompanying drawings.

BRIEF DESCRIPTION OF THE DRAWINGS

FIG. 6 is a top plan view of the planar substrate member;

FIG. 7 is a top plan view showing the pattern of the first conductive layer disposed thereon;

FIG. 8 is a view similar to that of FIG. 7 showing the pattern of a dielectric layer;

FIG. 9 is a view similar to that of FIG. 7 showing the pattern of a second conductive layer;

FIG. 10 is a view similar to that of FIG. 7 showing the pattern of an environmental sealing material;

FIG. 13 is a top plan view showing the pattern of a first conductive layer disposed on the substrate of FIG. 6;

FIG. 14 is a view similar to that of FIG. 13 showing the pattern, of the dielectric layer;

FIG. 15 is a view similar to that of FIG. 13 showing the pattern of a second conductive layer; and FIG. 16 is a view similar to that of FIG. 13 showing the pattern of the environmental sealing material.

DETAILED DESCRIPTION OF THE DRAWINGS

Figure 1:
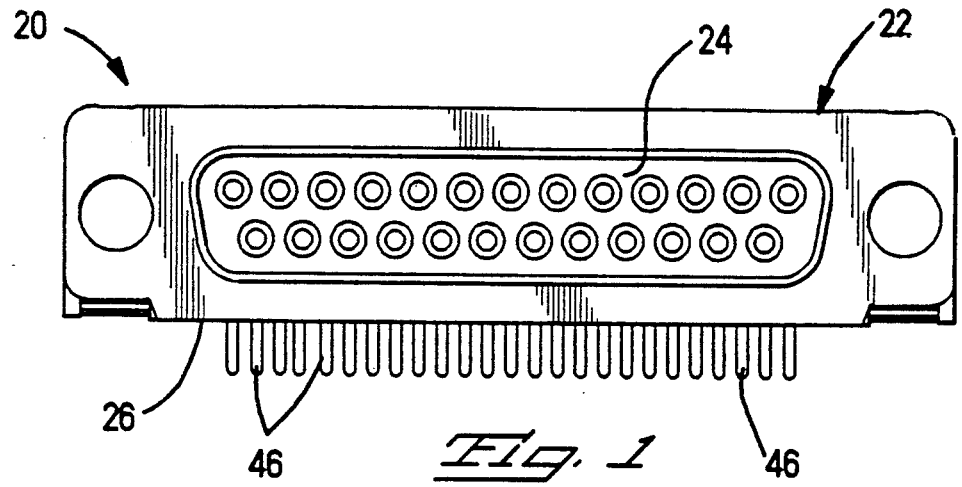
FIG. 1 is a front view of an electrical connector made in accordance with the invention.
Figure 2:
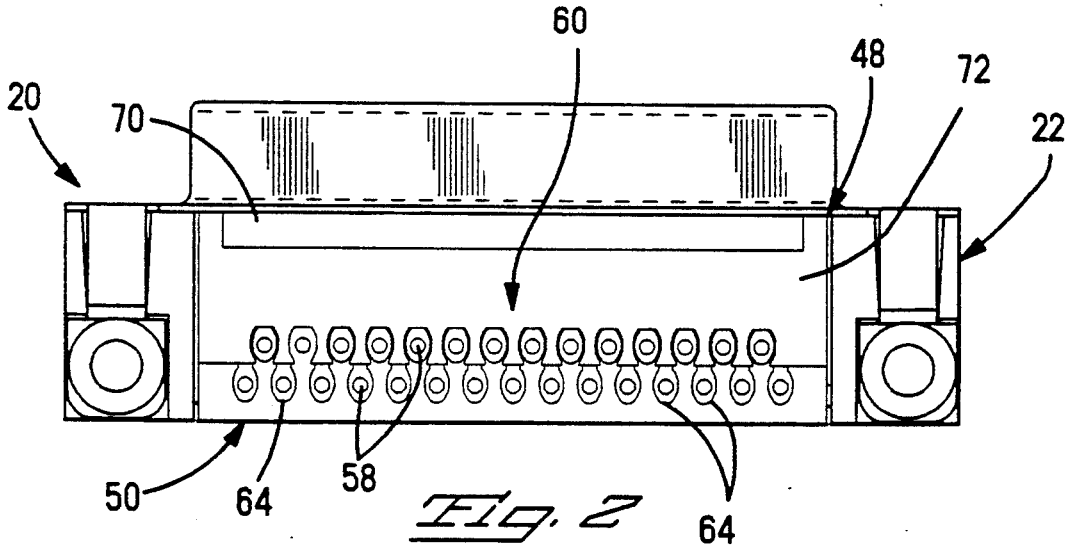
FIG. 2 is a bottom view of the connector of FIG. 1 illustrating the location of the filter means in accordance with the present invention.
Figure 3:
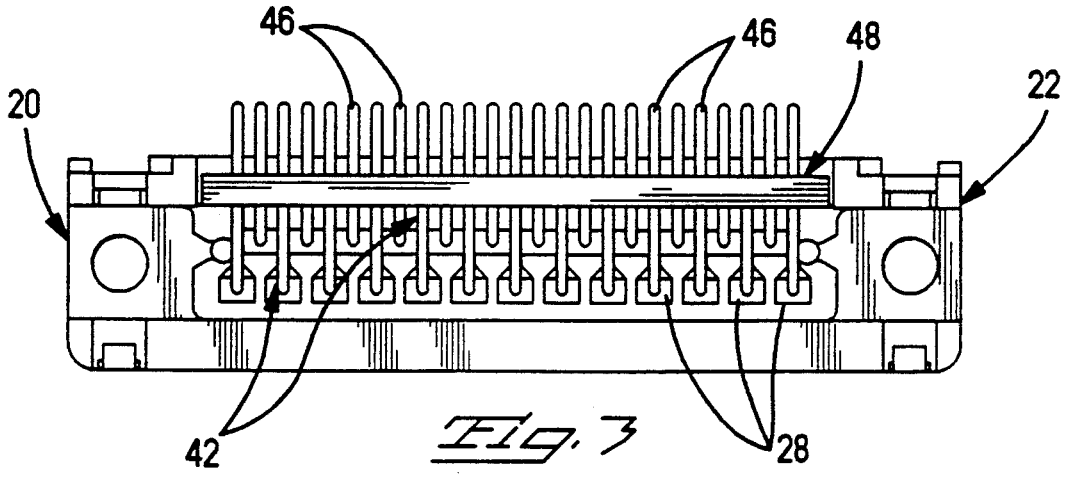
FIG. 3 is a back view of the connector of FIG. 1.

Referring now to FIGS. 1–4, filtered connector 20 of the present invention is comprised of a housing means 22, a plurality of terminal members 42, and a filter assembly 48 and grounding means 38. Housing means 22 has a mating face 24, a board mounting face 26 and a plurality of terminal receiving passageways 28 extending therebetween. For purposes of illustrating the invention, the filter assembly 48 is shown with a right angle connector, which further includes an insert seal 34 having a plurality of apertures 36 therein at the mating face thereof. Apertures 36 are aligned with terminal receiving passageways 28 in the housing. Ground shield 38 surrounds the forward portion of the connector 20 at its mating face 24 and includes downward extending portion 40 adapted to be electrically engaged with ground means of filter assembly 48. Electrical terminal members 42 include first and second connecting portions 44,46 and are disposed in the terminal receiving passageway 28 such that the first connecting portion 44 extends into a forward passageway section 30 of terminal passageway 28. First connecting portions 44 are adapted to mate with a corresponding terminal members in a complementary mating connector (not shown). The second connecting portions 46 of terminal members 42 extend outwardly of the rearward section 32 of passageway 28 and below the connector housing 22 and are adapted to be inserted into corresponding apertures of a circuit board (not shown).

Figure 5:
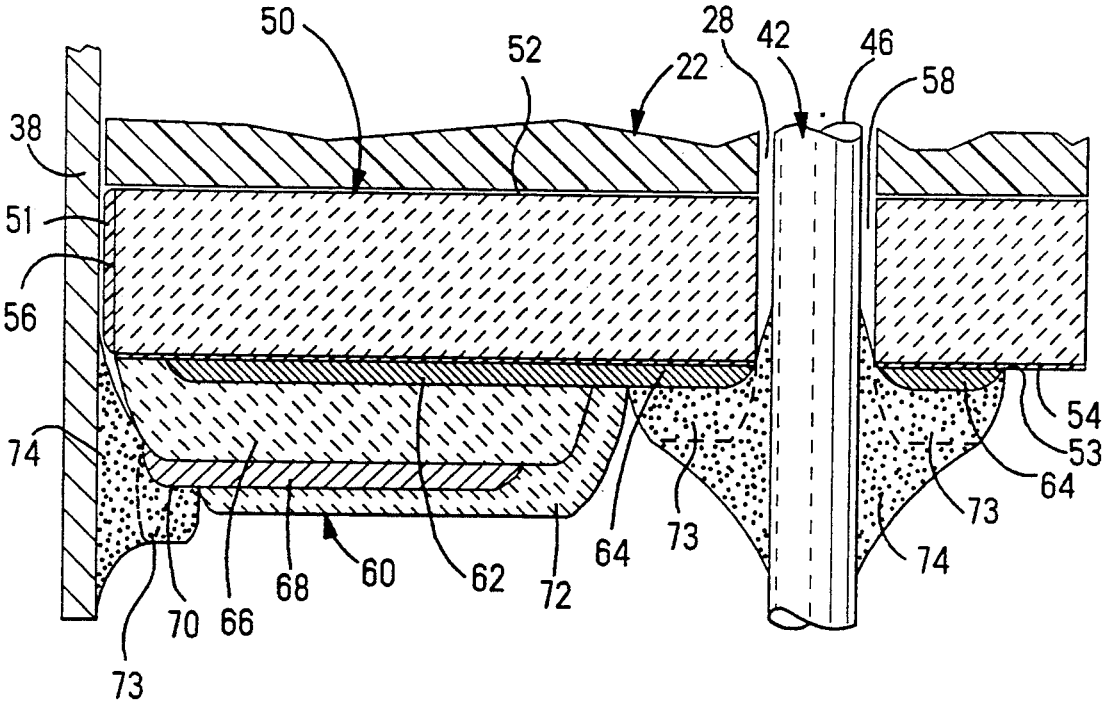
FIG. 5 is an enlarged fragmentary cross sectional view of the filter means in a preferred embodiment.
Figure 6:
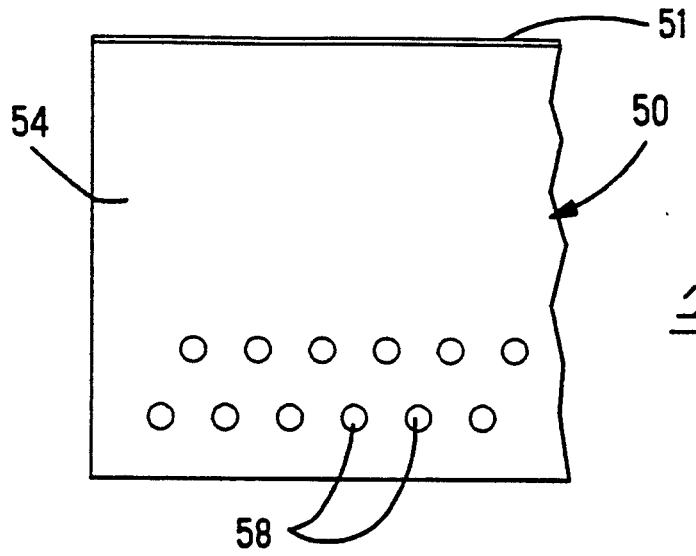
FIGS. 6–10 are top plan views of a fragmentary portion of the filter member illustrating the sequential configuration of the layers used in making the filter member of FIG. 5.
Figure 7:
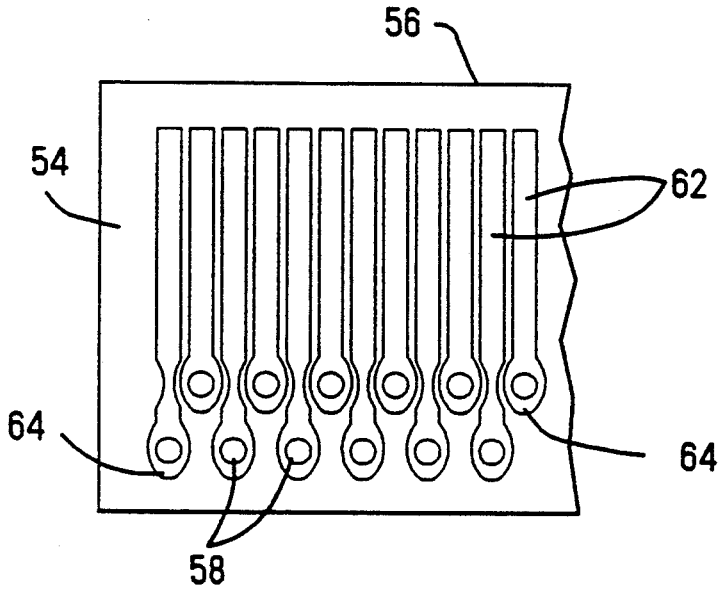
Figure 10:
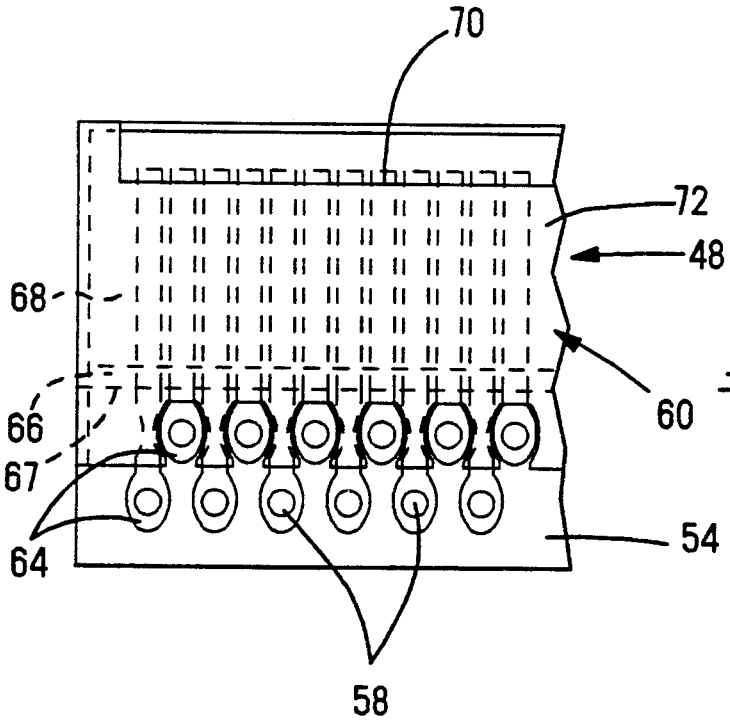

Filter assembly 48 includes a planar inductive substrate 50 having first and second major surfaces 52, 54 respectively and ends 56. Preferably the inductive substrate member is made of a ferrite material. The filter assembly 48 is disposed within connector 20 such that the first major surface 52 is adjacent the board mounting face 26 of the housing means 22. As shown in FIG. 6, planar filter substrate 50 has a plurality of terminal receiving passageways 58 extending between the major surfaces 52,54 and aligned with corresponding ones of the passageways 28 of the housing means 22. As best seen in FIGS. 5 and 10, the second major surface 54 has an array of capacitors 60 disposed thereon such that one capacitor 60 is associated with each terminal receiving passageway 58. For purposes of illustration, the capacitor array is shown on one major side of substrate 50. It is to be understood that some of the capacitors can also be formed on the other sides of the substrate thereby providing for larger capacitive values. The capacitors 60 are formed from conductive and dielectric materials that are disposed at selected locations on substrate surface 54. The first conductive layer may be deposited directly on the substrate 50 or an insulating layer of material 53, as shown in FIG. 5, may be disposed on the entire surface 54 prior to forming the capacitors 60. To electrically isolate ground from the inductive substrate 50, an insulating layer 51 may be disposed on substrate ends 56, such as shown in FIGS. 5 and 6. In the preferred embodiment, each capacitor 60 is defined by a first layer of electrically conductive layer of material including trace portion 62 and pad portion 64 associated with and surrounding respective ends of passageways 58, trace and pad portions defining signal electrodes. Each signal contact pad 64 is electrically engagable with a corresponding electrical terminal member 42 upon insertion into the associated passageway 58. The pattern of the signal electrodes is best seen by referring to FIG. 7.

Figure 8:
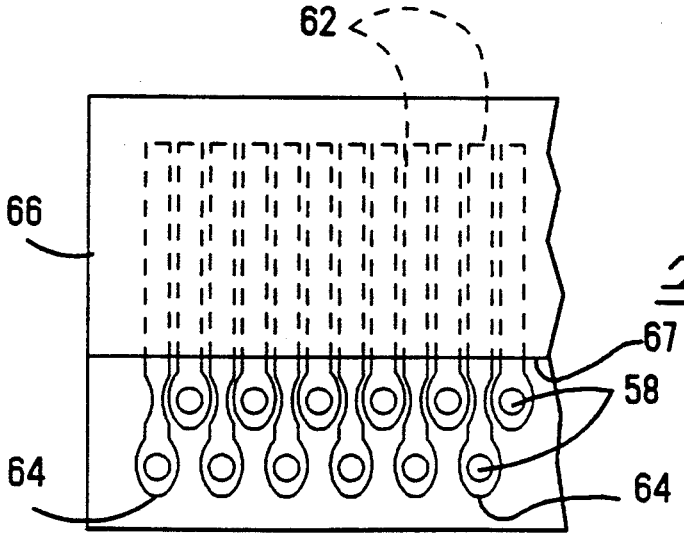

Referring now to FIGS. 5 and 8, a layer of a selected thickness of dielectric material 66 is disposed over the isolated signal electrodes 62. Preferably dielectric material 66 overlaps an equal portion of all of the signal electrodes 62 so that the same size capacitor is associated with each terminal member. The leading edge 67 of the dielectric lies adjacent the signal pad areas 64 which are left exposed for later electrical connection to the corresponding terminal members 42.

Figure 9:
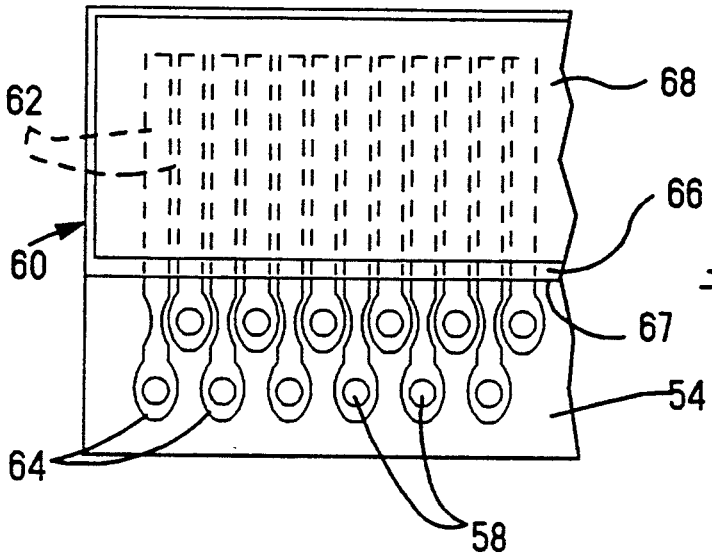

Referring now to FIGS. 5 and 9, a second conductive layer 68 is disposed over the dielectric material 66 such that layer 68 extends continuously along the surface of dielectric material 66 and is spaced a short distance from the leading edge 67 of dielectric material 66 thereby electrically isolating second conductive layer 68 from signal pads 64. Layer 68 defines a ground electrode for the capacitors 60. In the preferred embodiment conductive layer 68 is spaced from the back and side edges of the substrate so as to ensure electrical isolation between the ground layer 68 and ferrite substrate 50.

Figure 4:
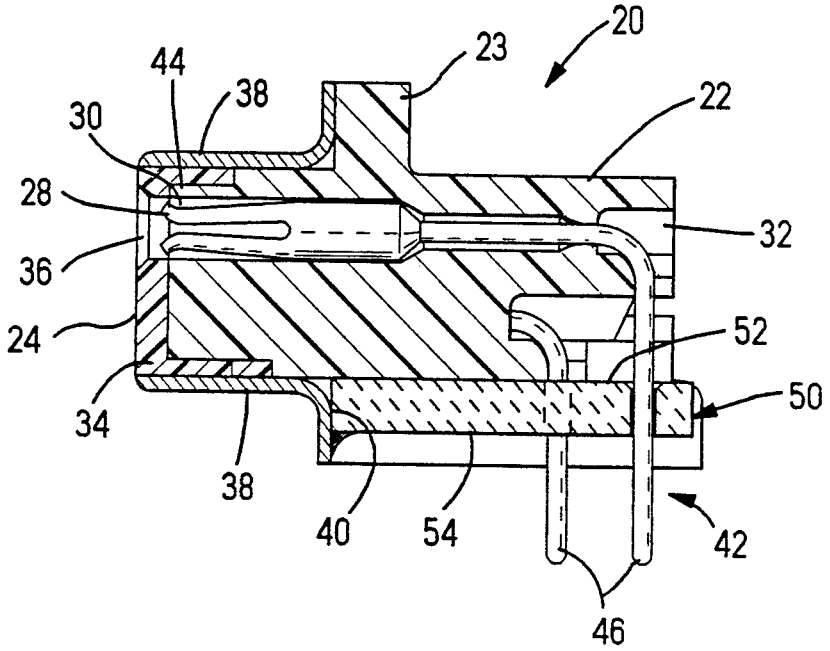
FIG. 4 is a cross sectional view of the connector of FIG. 1.

In addition, as shown in FIGS. 5 and 10, a major portion of the surface of the layers on substrate 50 may also be covered with a dielectric environmental sealing material 72 to seal all but the contact pads 64 surrounding respective apertures 58 and portion 70 of the ground conductive layer. The ground electrode 70 remains exposed along the back edge of filter assembly 48 for electrical connection to side 40 of shield 38 by conductive material 74 as shown in FIGS. 4 and 5. To facilitate the soldering of filter assembly 48 and shell wall 40, solder fillets 73 may be deposited at selected locations on the substrate surface such as at the signal pads 64 and ground electrode 70. The outline of fillets 73 are shown as broken lines in FIG. 5. Upon inserting the terminals into housing 22 and sliding the filter means onto the second connecting portions 46, the first major surface 52 of the filter assembly 48 lies adjacent the lower surface of housing 22 and capacitors 60 are electrically engagable with the terminal members 42. Upon soldering, the terminal members 42 are secured to and electrically engaged with the corresponding signal electrode 64 of the capacitor and the ground pad 70 is electrically connected to the shield 38. The solder 74 or other conductive means provides electrical interconnection of the capacitive elements to the terminal members 42 and mechanically secures the filter assembly 48 to the terminal members 42.

Figure 11:
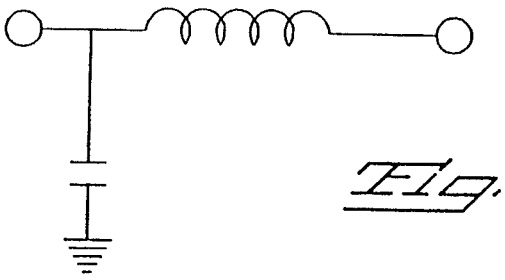
FIG. 11 is an electrical schematic drawing of the filter of the present invention.

FIG. 11 shows the electric schematic drawing of the combination of capacitor and inductor member provided by the filter assembly 48 of the present invention.

The inductance capacity of the inductive ferrite member 50 may be changed by altering the composition and thickness of the ferrite material. Preferably the ferrite member each would be in the range of 0.060–0.280 inches and have a high volume resistivity, at least greater than $10^8$ ohm cm. The ferrite material further provides mechanical support for the capacitors 60. The apertures 58 extending through the planar ferrite substrate member 50 are preferably slightly greater than the diameter of the second connecting portions 46 of terminal members 42 so as not to damage the ferrite member 50 as the terminal members are inserted to the apertures. Ferrite materials having various inductive properties are commercially available from suppliers such as D.M. Steward Manufacturing Co., Chattanooga, Tenn. under the trade name STEWARD 29, and Fair-rite Corp., Wallkill, N.Y. under the trade name FAIR-RITE 44. The capacitance of the respective capacitors may be varied by varying the type and thickness of dielectric material used to form the capacitors. A number of dielectric materials are commercially available. A number of conductive materials for forming the electrodes signal and ground are also available. Preferably the materials are screen printable conductive ink. A number of environmental sealing materials are also available on the market. It is important that the materials used for the conductive layers and the dielectric layers as well as the environmental sealant material, if used, are compatible with the soldering temperature so as not to melt during the soldering process.

Figure 12:
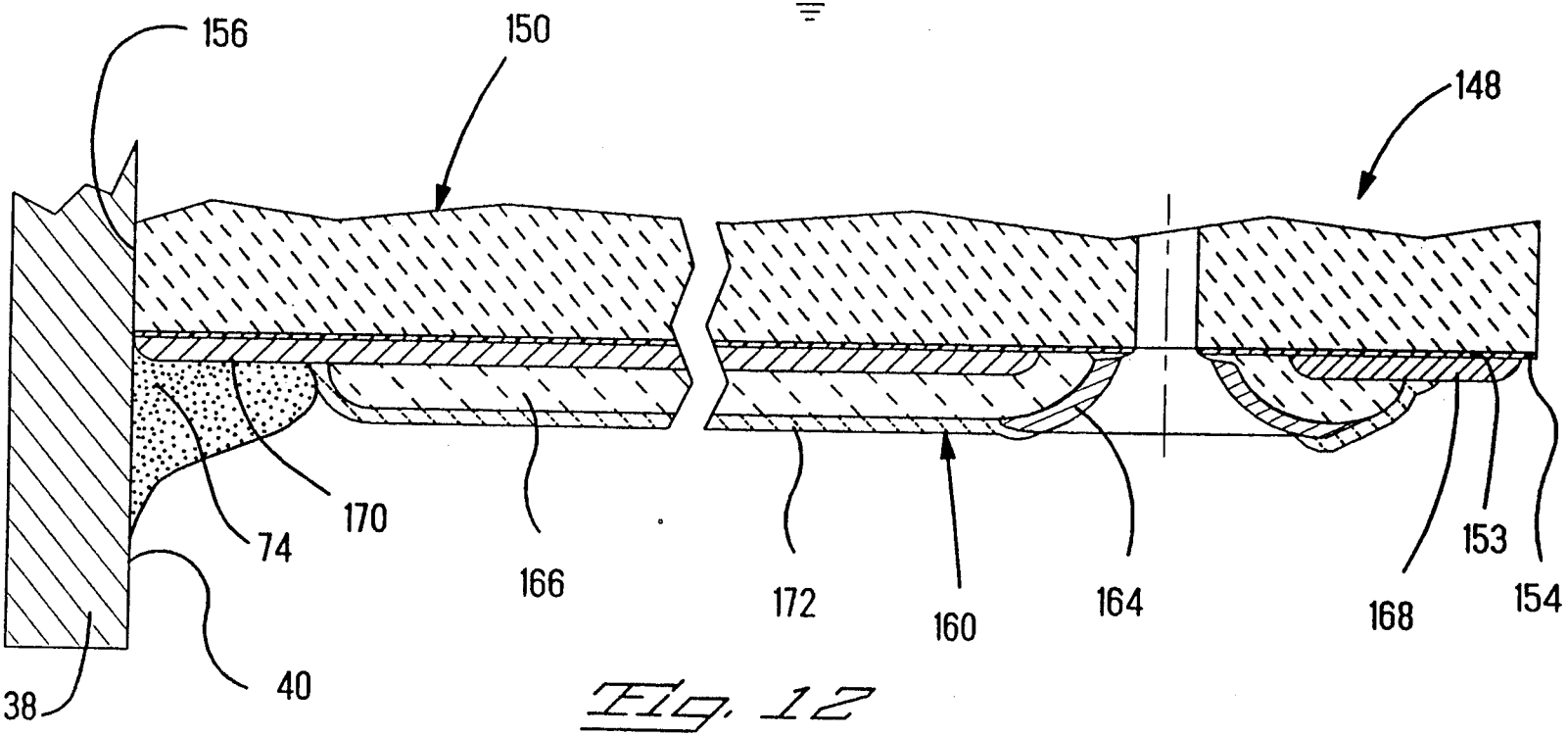
FIG. 12 is a view similar to that of FIG. 5 and illustrating an alternative embodiment of the filter member of the present invention.
Figure 13:
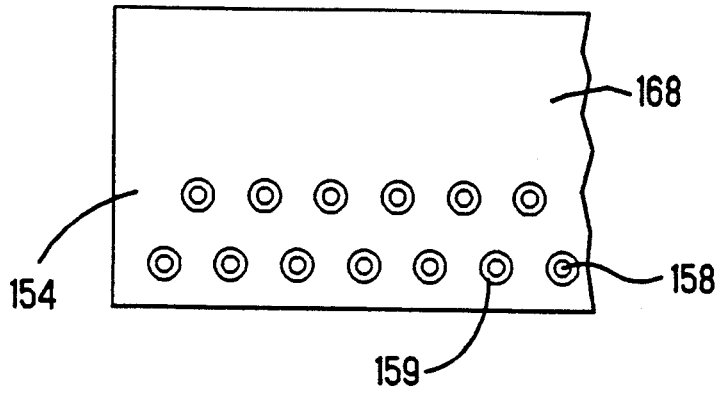
FIGS. 13–16 are top plan views of the fragmentary portion of the planar member illustrating the configurations of the layers in making the alternative filter embodiment of FIG. 12.
Figure 14:
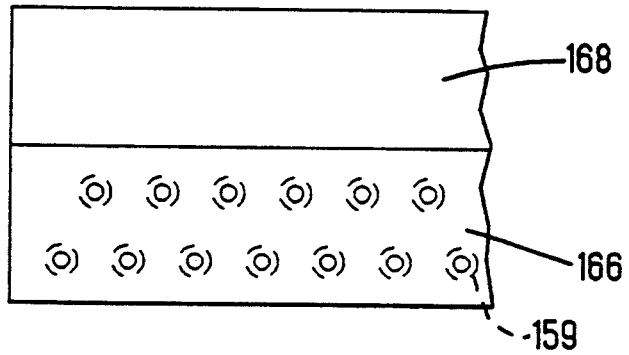
Figure 15:
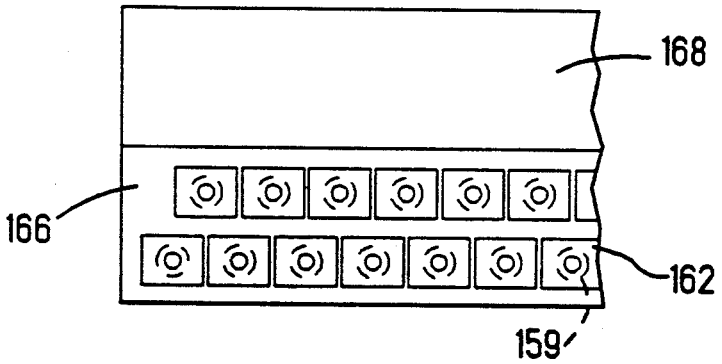
Figure 16:
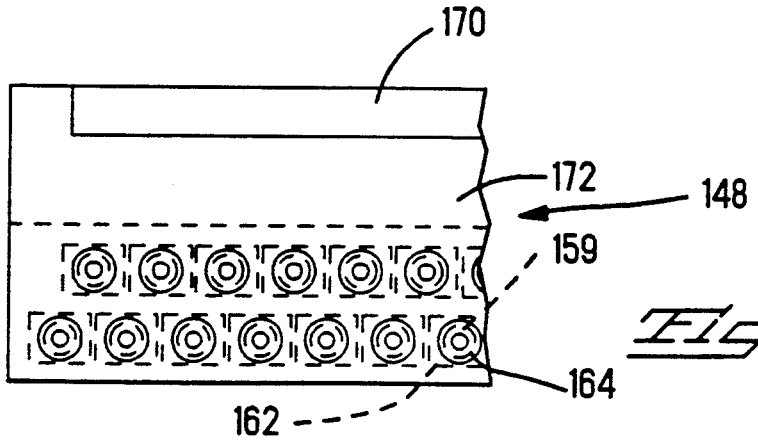

FIGS. 12–16 illustrate the structure of and steps in forming an alternative embodiment 148 of the filter assembly similar to that shown in FIG. 6. FIG. 12 shows an enlarged fragmentary cross-sectional view of the filter assembly 148 illustrating interconnection of assembly 148 with connector shield wall 40. In this embodiment, the ground electrode 168 of capacitor 160 is formed prior to the signal electrode layer 162 (FIGS. 15 and 16). If electrical isolation is desired between the ground electrode and the inductive substrate, the substrate 150 is first coated with a thin layer 153 of insulating material on the desired edges and at least one major surface, as previously described. For purposes of illustrating the invention, this layer is not shown in FIGS. 12–16. FIG. 13 illustrates a pattern of a first conductive layer 168 disposed at selected locations on the surface of the substrate. The conductive layer 168 forms the ground electrode portion of the filter assembly 148 and extends over the majority of the surface 154 of the substrate 150. The conductive layer 168 is spaced from the respective apertures 58 to provide exposed surface portions 159 surrounding each aperture 158.

FIG. 14 shows the layer 166 of dielectric material disposed over a portion of ground layer 168, the dielectric material 166 extending to the edge of the apertures 158 and overlying the substrate portion 159.

A second electrically conductive layer 162 is selectively disposed over the dielectric layer 166 to form areas surrounding each of the apertures 158. Portions of the dielectric layer 166 are exposed around the isolated areas of layer 162 of the second conductive layer 162 to ensure electrical isolation between the signal adjacent electrodes. As shown also in FIG. 15 the ground conductive layer 168 may remain exposed at the portion of the substrate not covered by dielectric material. It is important that the second conductive layer 162 be electrically isolated from the first conductive layer 168. A layer 172 of environmental sealing material is then used to coat the assembly. As shown in FIG. 16, the layer 172 environmental sealing material completely covers the surface of assembly 148 except for the exposed signal pads 164 around each terminal passageway and the exposed ground conductor 170 at the proximate one edge of the assembly 148. The filter assembly 148 is secured to the connector housing 22 and terminal members 46 in the same manner as previously described.

The combination of the inductance and capacitance of the filter assembly of the present invention provides higher attenuation values thereby enhancing the filtering performance of the connector using the assembly.

In the drawings and specification, there have been set forth preferred embodiments of the invention and although specific terms are employed therein, they are used in their generic descriptive sense and not for purposes of limitation.

We claim:

1. A filtered connector comprising a plastic, insulating housing having a plurality of conductive terminal members and a filter assembly, the connector housing having a mating face and a mounting face with a plurality of terminal member receiving passages extending therebetween, the housing including a forward portion and a ground shield surrounding said forward portion and a further portion including said mounting face with said ground shield extending proximate to such face, the plurality of terminal members extending from the mating face including contacts adapted to engage mating contacts of a further connector and including posts extending through the further portion and said mounting face of a length sufficient to extend beyond said mounting face and through a circuit board upon mounting thereto and be interconnected to the circuits thereof, and said housing mounting face being substantially flat at least adjacent said terminal posts and said ground shield proximate thereto and thereby adapted to receive said filter assembly closely thereagainst;

the filter assembly including a planar inductive substrate having an array of passageways for receipt of said terminal posts extending therethrough upon assembly, said inductive substrate being common to respective said posts extending through said passageways upon full assembly to form an inductance L relative to said posts, the substrate including first and second major surfaces with said first major surface securable directly against the housing mounting face and said second major surface positioned to fit proximate the upper surface of the circuit board upon mounting of the connector thereto, said substrate having at least one first electrode extending substantially over said second major surface of the substrate adjacent a respective said passageway, a dielectric layer extending substantially over each said at least one first electrode, and at least one second electrode extending substantially over said dielectric layer thereby defining at least one capacitor in a resulting filter member, with said passageways extending through said resulting filter member with said electrodes and dielectric layer and respective said posts extending through said passageways upon full assembly forming a capacitance C, and said electrodes including portions externally exposed relative to said connector upon assembly of said electrodes including portions externally exposed relative to said connector upon assembly of said filter assembly thereto with said first major surface adjacent said mounting face, whereby the filter assembly is an integral member manipulatable as a unit during assembly for placement onto the connector over ends of said terminal posts after said terminals have been secured within said housing, in a manner exposing said portions of said electrodes thereof upon placement to facilitate placement of solder and the application of heat thereto for soldering signal ones of said electrodes to said terminal pins and ground ones of said electrodes to said to said ground shield at locations visible for inspection thereafter forming an LC network for said connector after assembly.

2. The connector of claim 1 wherein said first electrode includes a portion proximate to said post and is soldered thereto with said second electrode including a portion proximate to said ground shield and being soldered thereto.

3. The connector of claim 1 wherein said first electrode includes a portion proximate to said ground shield and is soldered thereto and said second electrode includes a portion proximate to said post and is soldered thereto.

4. The connector of claim 1 wherein said terminals include right angle bends therealong between said contacts and posts thereof to form a right angle connector, and said ground shield includes a flange extending outwardly from said mounting face a length sufficient to extend slightly beyond said second major surface of said filter member for soldering to a ground one of said electrodes.

5. The connector of claim 1 wherein said filter assembly resides essentially within the cross-sectional profile of said housing and ground shield.

6. The connector of claim 1 wherein said first and second electrodes and said dielectric layer substantially cover said second major surface of said substrate and said substrate substantially covers said mounting face of said housing forming said LC network.

7. The connector of claim 1 wherein said planar substrate further includes a layer of insulating material disposed along at least one side edge of said substrate, and adapted to provide electrical isolation between said planar substrate and said ground shield.

8. The connector of claim 1 wherein said filter assembly further includes a layer of an environmental sealant material disposed on selected areas of said first and second electrodes.

9. The connector of claim 1 wherein said planar inductive substrate is a ferrite material.

10. The connector of claim 1 wherein said ground ones of said electrodes are commoned.

11. The connector of claim 1 wherein said at least one second electrode is soldered to said ground shield and is isolated from signal ones of said terminal posts and defines a ground electrode.

12. The connector of claim 1 wherein said at least one first electrode has annular edges proximate but spaced a selected distance from and surrounding a respective passageway entrance, thereby defining exposed annular substrate portions immediately adjacent said respective passageway entrance, said thickness of dielectric material being disposed at least on said exposed substrate portions about said passageway entrance and extending over said annular edges of said first electrode surrounding said passageway entrance, each said at least one second electrode associated with and surrounding said passageway entrance and overlying said dielectric material about said passageway, thereby forming at least a conductive pad portion at said passageway entrance, each said pad portion having an inner and outer edge, said outer edge extending outwardly from said passageway to partially overly said annular edges of said at least one first electrode but electrically isolated therefrom.

13. The connector of claim 12 wherein a layer of dielectric material is disposed on said second major surface between said at least one first electrode and said second major surface, thereby electrically isolating said at least one first electrode from said inductive planar substrate.

* * * * *